US011339658B2

(12) United States Patent
Zhou et al.

(10) Patent No.: US 11,339,658 B2
(45) Date of Patent: May 24, 2022

(54) METHOD FOR RECOVERING ROOM-TYPE COAL PILLARS BY CEMENTED FILLING OF RESERVED ROADWAYS

(71) Applicant: CHINA UNIVERSITY OF MINING AND TECHNOLOGY, Jiangsu (CN)

(72) Inventors: Nan Zhou, Jiangsu (CN); Meng Li, Jiangsu (CN); Hao Yan, Jiangsu (CN); Jixiong Zhang, Jiangsu (CN); Hengfeng Liu, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 284 days.

(21) Appl. No.: 16/613,926

(22) PCT Filed: Sep. 20, 2018

(86) PCT No.: PCT/CN2018/106591
§ 371 (c)(1),
(2) Date: Nov. 15, 2019

(87) PCT Pub. No.: WO2020/010696
PCT Pub. Date: Jan. 16, 2020

(65) Prior Publication Data

US 2021/0355826 A1 Nov. 18, 2021

(30) Foreign Application Priority Data

Jul. 9, 2018 (CN) ..... 201810744190.6

(51) Int. Cl.
*E21C 41/16* (2006.01)
*E21C 41/18* (2006.01)
*E21F 15/00* (2006.01)

(52) U.S. Cl.
CPC ..... *E21C 41/18* (2013.01); *E21F 15/005* (2013.01)

(58) Field of Classification Search
CPC ..... E21C 41/18
See application file for complete search history.

(56) References Cited

U.S. PATENT DOCUMENTS 4,174,135 A * 11/1979 Grenia ..... E21C 41/00 299/11
4,219,237 A 8/1980 Sisemore
(Continued)

FOREIGN PATENT DOCUMENTS

CN 101858217 A 10/2010
CN 102061938 A 5/2011
(Continued)

*Primary Examiner* — Janine M Kreck
(74) *Attorney, Agent, or Firm* — Schmeiser, Olsen & Watts, LLP

(57) ABSTRACT

Provided is a method for recovering room-type coal pillars by cemented filling of reserved roadways, which is especially suitable for safe and efficient recovery of left coal pillars in room-type mining faces in mining areas where the ecological system is fragile, such as in western China. In the method, by constructing reserved roadways in two adjacent rows of room-type goafs, excavating coal pillar roadways in room-type coal pillars, and finally interconnecting the reserved roadways with the coal pillar roadways to form a U-shaped working face, room-type left coal pillars are recovered. Thus, not only the workload of roadway excavation is reduced, but also the recovery ratio of the coal resources is maximized. The method provides a novel technical model for the recovery of room-type left coal pillars in mining areas, such as in western China.

4 Claims, 3 Drawing Sheets

(56) References Cited

U.S. PATENT DOCUMENTS

| | | | | |
|---|---|---|---|---|
| 4,400,035 | A * | 8/1983 | Barsi | E21C 41/18<br>299/11 |
| 2019/0301283 | A1 | 10/2019 | Zhang et al. | |

FOREIGN PATENT DOCUMENTS

| | | | |
|---|---|---|---|
| CN | 103104287 | A | 5/2013 |
| CN | 103527197 | A | 1/2014 |
| CN | 108087021 | A | 5/2018 |
| WO | 2015062195 | A1 | 5/2015 |

* cited by examiner

METHOD FOR RECOVERING ROOM-TYPE COAL PILLARS BY CEMENTED FILLING OF RESERVED ROADWAYS

CROSS-REFERENCE TO RELATED APPLICATIONS

This application claims priority to PCT Application No. PCT/CN2018/106591, having a filing date of Sep. 20, 2018, which is based on Chinese Application No. 201810744190.6, having a filing date of Jul. 9, 2018, the entire contents both of which are hereby incorporated by reference.

FIELD OF TECHNOLOGY

The following relates to a method for recovering room-type coal pillars by cemented filling of reserved roadways, and belongs to the field of coal mine recovery.

BACKGROUND

As the coal resources in China are depleted gradually, the mining areas in western China have become main mining areas for coal resource mining in China. Limited by factors such as outdated mining techniques and equipment, etc., a short-wall room or room-pillar mining method is usually employed in most of the coal mines in that region. As a result, a large quantity of high-quality coal resources are left in the goafs and the recovery ratio of coal resources is lower than 40%, resulting in severe waste of the coal resources and instability of the coal pillars in the goafs. Consequently, serious ecological environment disasters such as mine earthquake, surface subsidence, water inrush, and sand burst, etc. may occur easily.

Recovery of left coal pillars by cemented filling is a green and environment-friendly coal pillar recovery method developed in recent years, and has been widely applied in the process of strip coal pillar recovery. However, it is difficult to apply the cemented filling technique in the recovery process of room-type coal pillars, because the room-type goafs are interconnected and there is no appropriate closed filling environment. If closed retaining walls are constructed to form a closed filling space, it is necessary to re-excavate the roadways in the subsequent coal pillar recovery process, which not only costs a lot but also involves a complex process. Therefore, how to construct an appropriate closed filling environment and reduce the workload of roadway excavation in the room-type coal pillar recovery process has become a big problem to be solved urgently in areas where the ecological system is fragile, for example in the mining areas in western China.

SUMMARY

An aspect relates to a method for recovering room-type coal pillars by cemented filling of reserved roadways, which can not only be used to construct an appropriate closed filling environment, but also can reduce the workload of roadway excavation in the subsequent filling process, and has technical advantages including high safety, high efficiency, and high economic efficiency.

A method for recovering room-type coal pillars by cemented filling of reserved roadways is disclosed, which includes the following steps:

step a) utilizing two adjacent rows of coal pillars perpendicular to a main roadway as a working face, constructing reserved roadways in the room-type goafs between the two rows of coal pillars respectively, and interconnecting two roadways along the boundary coal pillars away from the main roadway, so that the coal pillars are combined with the reserved roadways to form a U-shaped working face;

step b) arranging a cemented filling transport pipeline in the main roadway for transportation of cemented filling material, and transporting the cemented filling material to a right goaf and a central goaf of the U-shaped working face through the cemented filling delivery pipeline, so as to implement filling of the room-type goafs of the current U-shaped working face;

step c) after the cemented filling material solidifies and reaches certain strength, excavating a coal pillar roadway sequentially in each of the coal pillars along the reserved roadways of the U-shaped working face with a continuous coal miner, and interconnecting the reserved roadways with the coal pillar roadways into a loop;

step d) after all of the above work is completed, sequentially expanding and mining the coal pillar roadways in the U-shaped working face that forms a loop through a blasting mining process, and transporting the recovered coal resources to the ground surface by means of loaders and trackless rubber-tired vehicles; and step e) after the left coal pillars in the U-shaped working face are mined, building a closed retaining wall at the junctions between the upper and lower ports of the U-shaped working face and the main roadway for transportation of cemented filling material respectively.

The method for recovering room-type coal pillars by cemented filling of reserved roadways described above is characterized in: when the U-shaped working face is treated through the steps a) to e), a next U-shaped working face is constructed beside the current U-shaped working face in the same way as that in the step a) whenever the filling operation is carried out in the step b), and the new U-shaped working face is treated cyclically through the steps a) to e), till the entire room-type left coal pillar recovery work is completed.

The method for recovering room-type coal pillars by cemented filling of reserved roadways described above is characterized in: in the step c), a coal pillar roadway with a width of 6 meters is excavated in each of the coal pillars sequentially with the continuous coal miner along the reserved roadways in the U-shaped working face.

The method for recovering room-type coal pillars by cemented filling of reserved roadways described above is characterized in: the widths of the reserved roadways are determined according to the actual mining equipment in the mine, the dimensions of the left coal pillars, and the stress in the surrounding rock mass.

The present disclosure has the following advantages: the method provided in the present disclosure is especially suitable for safe and efficient recovery of left coal pillars in room-type mining working faces in mining areas where the ecological system is fragile, such as in western China. In the method, by constructing reserved roadways in two adjacent rows of room-type goafs, excavating coal pillar roadways in room-type coal pillars, and finally interconnecting the reserved roadways with the coal pillar roadways to form a U-shaped working face, room-type left coal pillars are recovered. Thus, not only the workload of roadway excavation is reduced, but also the recovery ratio of the coal resources is maximized. The method provides a novel technical model for recovery of room-type left coal pillars in mining areas, such as in western China, is of great scientific and engineering significance, and has broad application prospects.

BRIEF DESCRIPTION

Some of the embodiments will be described in detail, with reference to the following figures, wherein like designations denote like members, wherein.

In the drawings.

Figure 1:
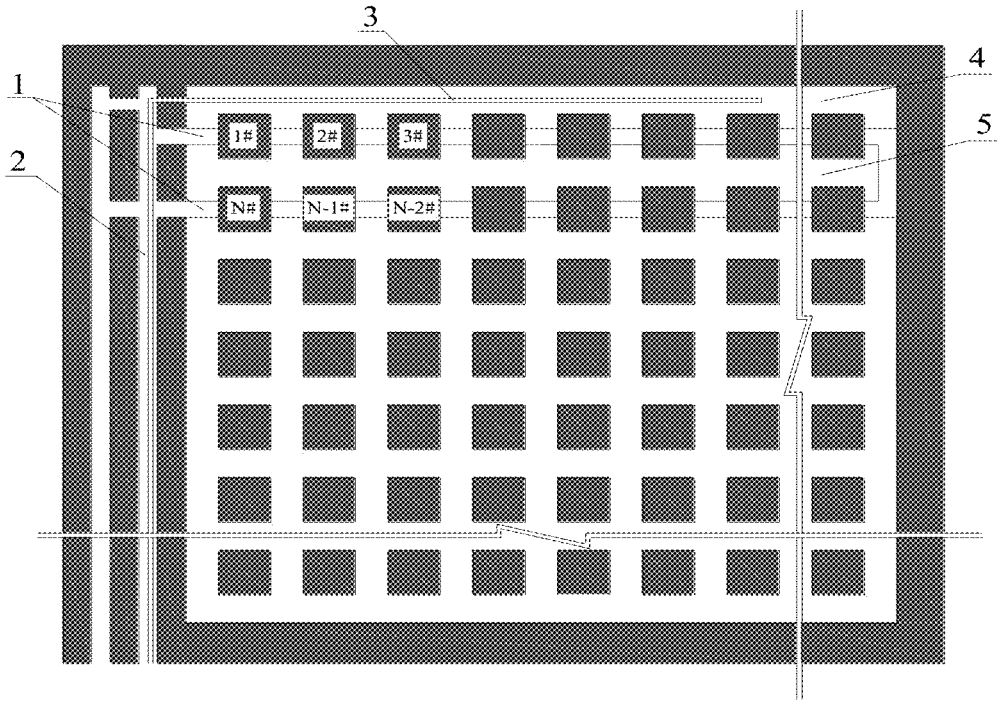
FIG. 1 is a plan view of a U-shaped working face formed by a combination of coal pillars and reserved roadways according to embodiments of the present disclosure.

1—reserved roadway; 2—main roadway for transportation of cemented filling materials; 3—cemented filling transport pipeline; 4—right goaf of U-shaped working face 01; 5—central goaf of U-shaped working face 01; 6—cemented filling materials; 7—continuous coal miner; 8—coal pillar roadway; 9—right goaf of U-shaped working face 02; 10—central goaf of U-shaped working face 02; 11—loader; 12—trackless rubber-tired vehicle; 13—closed retaining wall.

DETAILED DESCRIPTION

Hereunder the present disclosure will be further detailed, with reference to the accompanying drawings. The following embodiments are used only for explaining the solution of the present disclosure more clearly rather than constituting any limitation to the scope of protection of the present disclosure.

The method provided in the present disclosure mainly includes the following steps:

a. utilizing two adjacent rows of coal pillars perpendicular to a main roadway as a working face, constructing reserved roadways in the room-type goafs between the two rows of pillars respectively, and interconnecting the two roadways along the boundary coal pillars away from the main roadway, so that the coal pillars are combined with the reserved roadways to form a U-shaped working face 01. The reserved roadway has a U-shaped cross section, employs recyclable mechanical baffles, is provided with air leakage-proof devices inside it, and thereby has high leak tightness and high deformation resistance performance. The widths of the reserved roadways are determined according to the actual mining equipment in the mine, the dimensions of the left coal pillars, and the stress in the surrounding rock mass;

b. arranging a cemented filling transport pipeline in the main roadway for transportation of cemented filling material, and transporting the cemented filling materials to a right goaf and a central goaf of the U-shaped working face 01 through the cemented filling delivery pipeline, so as to implement filling of the room-type goafs of the current U-shaped working face 01; while the filling work is carried out, constructing a U-shaped working face 02 in the same way as that in the step a;

c. after the cemented filling materials solidify and reach certain strength, excavating a coal pillar roadway with a width of 6 meters sequentially in the coal pillars 1#, 2#, 3#, . . . , N# along the reserved roadways of the U-shaped working face 01 with a continuous coal miner, and interconnecting the reserved roadways with the coal pillar roadways into a loop finally.

Filling a right goaf and a central goaf of the U-shaped working face 02 in the same way as that in the step b), while the coal pillar roadways are excavated;

d. after all of the above work is completed, sequentially expanding and mining the coal pillar roadways in the coal pillars 1#, 2#, 3#, . . . , N# in the U-shaped working face 01 through a blasting mining process, and transporting the recovered coal resources to the ground surface by means of loaders and trackless rubber-tired vehicles, etc.; constructing a U-shaped working face 03 while the coal pillar roadways in the U-shaped working face 01 are expanded and mined;

e. after the left coal pillars in the U-shaped working face 01 are mined, building a closed retaining wall at the junctions between the upper and lower ports of the U-shaped working face 01 and the main roadway for transportation of cemented filling material respectively;

f. repeating the above steps to complete the entire room-type left coal pillar recovery work.

The specific data in this embodiment is as follows: short-wall room-type mining is used in a mine in Northern Shaanxi, the main coal seam is coal seam 3# with a coal thickness of 2.5 meters and an average inclination angle of 1°, the strike length of the working face is 150 meters, the advancing distance is 80 meters, the dimensions of the coal pillars are 11 meters×11 meters, and the width of coal room is 7 meters. A large number of room pillars are left underground, and the recovery ratio of the coal resources is lower than 35%. In addition, in recent years, it is found that some coal pillars are unstable and destroyed, with spontaneous ignition tendency, which in turn leads to series of disasters, such as large-area roof collapse, etc.

Figure 2:
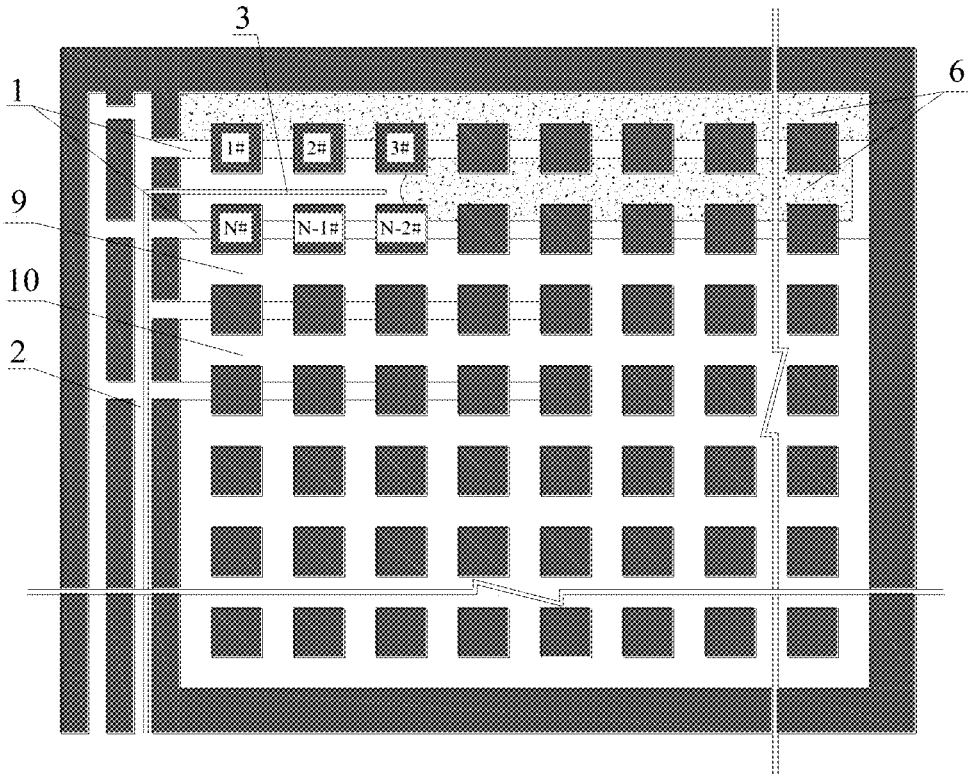
FIG. 2 is a plan view of filling of the right and central goafs of the U-shaped working face according to embodiments of the present disclosure.
Figure 3:
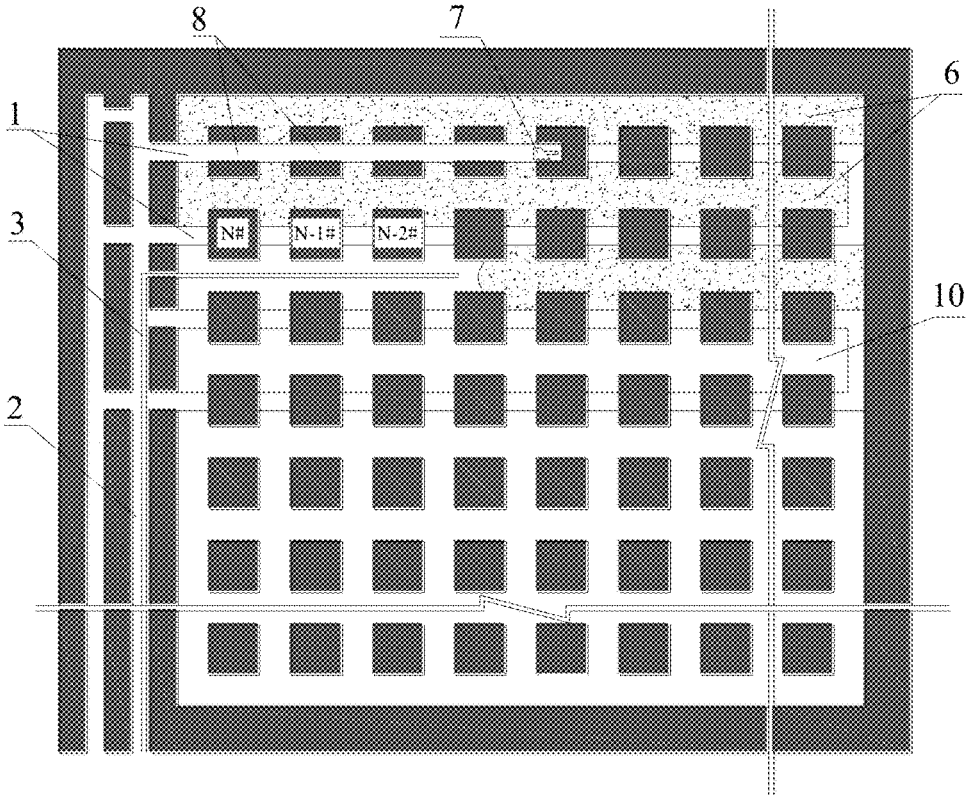
FIG. 3 is a plan view of excavation of coal pillar roadways in the room-type coal pillars in the U-shaped working face according to embodiments of the present disclosure.
Figure 4:
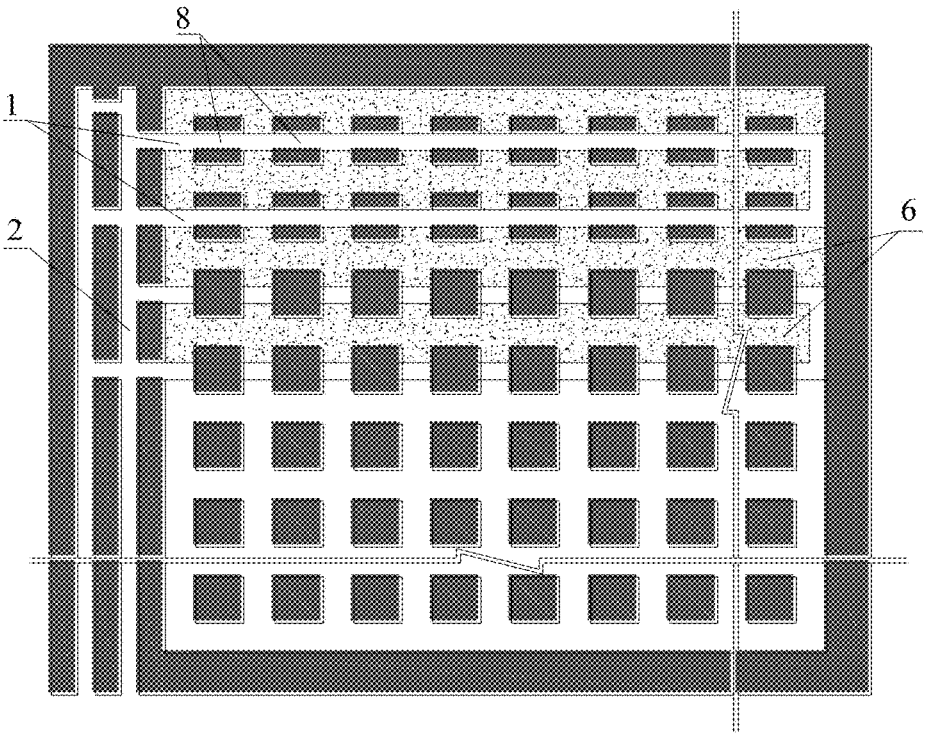
FIG. 4 is a plan view of the loop formed by interconnecting the reserved roadways and coal pillar roadways in the U-shaped working face according to embodiments of the present disclosure.
Figure 5:
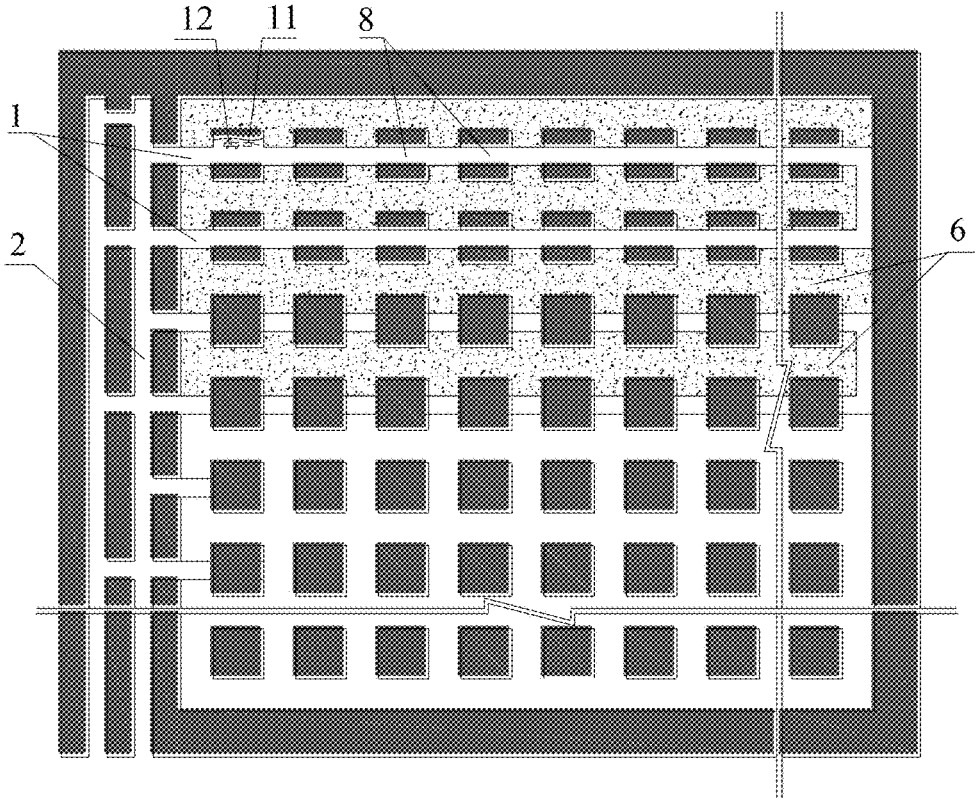
FIG. 5 is a plan view of the expansion work of the coal pillar roadways in the U-shaped working face according to embodiments of the present disclosure.
Figure 6:
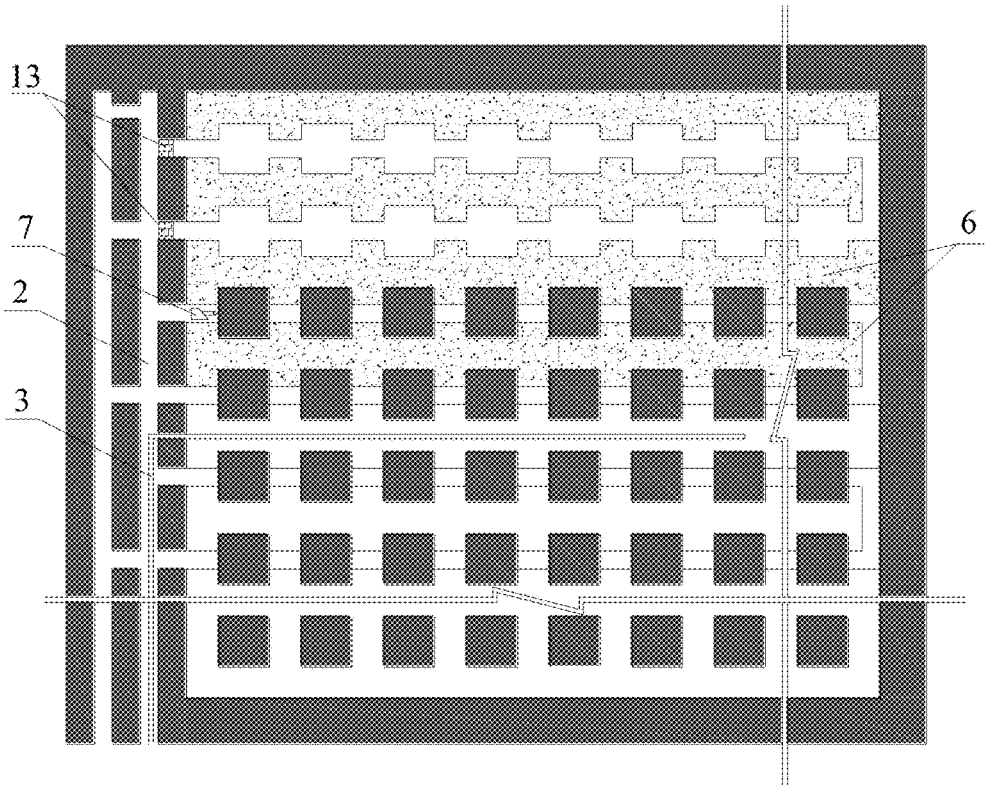
FIG. 6 is a plan view of the U-shaped working face after the expansion and mining work of all coal pillar roadways is finished according to embodiments of the present disclosure.

In order to solve the above problems, based on the technical content in the present disclosure, the specific method for mining the left coal pillars in the first mining face is as follows:

for the room-type goafs in the first mining face, for example in the Liupan region, a reserved roadway 1 with a width of 6 meters is constructed in each of the room-type goafs between the two adjacent rows of coal pillars perpendicular to the main roadway respectively, two rows of roadways are interconnected along the boundary coal pillars away from the main roadway, so that the coal pillars are combined with the reserved roadways 1 to form a U-shaped working face 3601, as shown in FIG. 1;

a cemented filling transport pipeline 3 is arranged in the main roadway 2 for transportation of cemented filling materials, cemented filling materials 6 prepared mainly from aeolian sand on the ground surface are transported to a right goaf 4 and a central goaf 5 of the U-shaped working face 3601 sequentially to fill the goafs with a step-back filling method, and the pumping pressure and the pipe orifice height are regulated and controlled reasonably, so that the filled materials are compacted gradually and contact with the roof to realize full filling. A U-shape working face 3602 is constructed while the filling work is started, as shown in FIG. 2;

After the cemented filling material 6 solidify and reach certain strength, a continuous coal miner 7 is installed in the reserved roadways 1, and coal pillar roadways 8 in the same cross sectional dimensions as the reserved roadways 1 are excavated sequentially in the coal pillars 1#, 2#, 3#, . . . , N# on the periphery of the U-shaped working face 3601 along the reserved roadway 1, so that the reserved roadways 1 are interconnected with the coal pillar roadways 8 into a loop. The filling work of the right goaf 9 and the central goaf 10 of a U-shaped working face 3602 is started, while the coal pillar roadways 8 are excavated in the coal pillar 1#, as shown in FIGS. 3 and 4;

After all of the above work is completed, the coal pillar roadways 8 in the coal pillars 1#, 2#, 3#, . . . , N# in the U-shaped working face 3601 are expanded and mined through a blasting mining process; in the roadway expansion and mining process, the residual coal on one side of the coal pillar roadway 8 is mined until the mining is completed and filling materials are seen, then the residual coal on the other side is mined, and the falling coal is loaded by means of loaders 11 into trackless rubber-tired vehicles 12 and transported to the ground surface. The construction of a U-shaped working face 3603 is started while the coal pillar roadway 1# is expanded and mined, as shown in FIG. 5;

After the left coal pillars in the U-shaped working face 3601 are mined, closed retaining walls 13 are built up at the junctions between the upper and lower ports of the U-shaped working face and the main roadway for transportation of cemented filling material respectively. Now, the goaf filling and pillar recovery work for the U-shaped working face 3601 is completed, as shown in FIG. 6.

The above steps are repeated to complete the entire room-type goaf coal pillar recovery work.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A method for recovering room-type coal pillars by cemented filling of reserved roadways, comprising:

a) utilizing two adjacent rows of coal pillars perpendicular to a main roadway as a working face, constructing reserved roadways between pillars in the two adjacent rows of coal pillars respectively, and interconnecting the reserved roadways along the boundary coal pillars away from the main roadway, so that the coal pillars are combined with the reserved roadways to form a U-shaped working face;

b) arranging a cemented filling transport pipeline in the main roadway for transportation of cemented filling materials, and transporting the cemented filling materials to a first side goaf and a central goaf of the U-shaped working face through the cemented filling delivery pipeline, so as to implement filling of the room-type goafs of the current U-shaped working face;

c) after the cemented filling material solidify and reach a certain strength, excavating a coal pillar roadway sequentially in each of the coal pillars along the reserved roadways of the U-shaped working face with a continuous coal miner, and interconnecting the reserved roadways with the coal pillar roadways into a loop;

d) after all of the above work is completed, sequentially expanding and mining the coal pillar roadways in the coal pillars in the U-shaped working face that forms a loop through a blasting mining process, and transporting the recovered coal resources to the ground surface by means of loaders and trackless rubber-tired vehicles;

e) after second side coal pillars in the U-shaped working face are mined, building a closed retaining wall at the junctions between upper and lower ports of the U-shaped working face and the main roadway for transportation of cemented filling material respectively.

2. The method according to claim 1, wherein when the U-shaped working face is treated through the steps a) to e), a next U-shaped working face is constructed beside the current U-shaped working face in the same way as that in the step a) whenever the filling operation is carried out in the step b), and the new U-shaped working face is treated cyclically through the steps a) to e), till the entire room-type second side coal pillar recovery work is completed.

3. The method according to claim 1, wherein, in the step c), a coal pillar roadway with a width of 6 meters is excavated in each of the coal pillars sequentially with the continuous coal miner along the reserved roadways in the U-shaped working face.

4. The method according to claim 1, wherein, the widths of the reserved roadways are determined according to the actual mining equipment in the mine, the dimensions of the left coal pillars, and the stress in the surrounding rock mass.

* * * * *